US007001235B2

(12) United States Patent
Baldwin

(10) Patent No.: US 7,001,235 B2
(45) Date of Patent: Feb. 21, 2006

(54) SURFACE MARKER BUOY APPARATUS

(76) Inventor: Jim Baldwin, 1 Woodlands Road, Elland (GB) HX5 9HR ( * ) Notice: Subject to any disclaimer, the term of this patent is extended or adjusted under 35 U.S.C. 154(b) by 0 days.

(21) Appl. No.: 10/250,966

(22) PCT Filed: Jan. 8, 2002

(86) PCT No.: PCT/GB02/00047

§ 371 (c)(1),
(2), (4) Date: Oct. 23, 2003

(87) PCT Pub. No.: WO02/055378

PCT Pub. Date: Jul. 18, 2002

(65) Prior Publication Data

US 2004/0116012 A1 Jun. 17, 2004

(30) Foreign Application Priority Data

Apr. 20, 2002 (GB) ..... 0108457

(51) Int. Cl.
*B63B 22/16* (2006.01)

(52) U.S. Cl. ..... 441/30; 441/6

(58) Field of Classification Search ..... 441/1, 441/6, 21, 23–26, 30; 114/315, 54; 440/6, 440/30

See application file for complete search history.

(56) References Cited

U.S. PATENT DOCUMENTS

| | | | | |
|---|---|---|---|---|
| 5,141,458 A | | 8/1992 | Church | |
| 5,173,067 A | * | 12/1992 | Biba | 441/25 |
| 5,231,952 A | * | 8/1993 | Tenniswood | 116/210 |
| 5,403,219 A | | 4/1995 | Ryan | |
| 5,605,481 A | | 2/1997 | Van Raden | |
| 5,735,719 A | * | 4/1998 | Berg | 441/11 |

FOREIGN PATENT DOCUMENTS

DE 200 15 158 A 4/2001

* cited by examiner

*Primary Examiner*—Ed Swinehart
(74) *Attorney, Agent, or Firm*—Egbert Law Offices

(57) ABSTRACT

A surface marker buoy apparatus is provided for use in diving and in particular for use in assisting a diver during his ascent. The apparatus includes an inflatable buoy which can be inflated when required to float and can be folded or rolled up when deflated. The buoy is secured to an anchoring device which defines a filling conduit for the buoy. The conduit has an ingress at one end and at its other end defines an aperture with a rim. A reel is provided which has a locking device that can be set to oppose rotation of the reel. A line, such as a conventional decompression line, is wound around the reel and attached directly or indirectly to the inflatable buoy at its free end. Preferably, the locking device is operated by a finger-catch deployed to unlock the reel by the diver using only one hand.

16 Claims, 6 Drawing Sheets

SURFACE MARKER BUOY APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a surface marker buoy apparatus for use in diving and in particular to an ascent decompression device for a diver.

BACKGROUND OF THE INVENTION

When a diver wishes to ascend to the surface, he normally deploys a surface marker buoy attached to a line. The buoy is inflated by the diver underwater, using either compressed air from his air cylinder or exhaled air, and is then released to rise to the surface carrying a line which unwinds from a reel retained by the diver. The buoy indicates the position of the diver to those on the surface in a recovery vessel and the line is used by the diver to mark the stages of his decompression as he ascends, the slack line being rewound by the diver on to the reel as he rises up it.

Conventionally, the surface marker buoys used by divers for this purpose comprise an inflatable bag which the diver takes with him on a dive in a rolled up state. Likewise, the decompression line is wound around a reel, which he also stores. When he wishes to deploy the buoy, the diver clips the end of the line to a loop attached to the buoy, then holding the mouth of the buoy open, he must inflate it sufficiently with air to send it on its way to the surface and at the same time release the lock on the reel to permit it to unwind as the buoy pulls off the line during its ascent.

The problem with the aforementioned arrangement is that it is difficult for the diver to hold open the mouth of the buoy whilst at the same time manipulating his mouthpiece to inflate the buoy and the reel to release its lock. This can be dangerous as the line may tangle or the diver may unintentionally loosen the pressure on the lock on the reel, which will prevent the line from being released from the reel. In both these cases the buoy may drag the diver upwardly at high speed, without enabling him to decompress safely. An additional problem is that the buoy may be released before it is sufficiently inflated to rise to the surface.

The object of the present invention is to overcome or substantially mitigate the aforementioned disadvantages.

BRIEF SUMMARY OF THE INVENTION

According to the present invention there is provided a surface marker buoy apparatus comprising an inflatable buoy which can be inflated when required to float and can be folded or rolled up when deflated; a reel that is provided with a locking means which can be set to oppose rotation of the reel; a line wound around the reel and attached directly or indirectly to the inflatable buoy at its free end; and an anchoring means to which the buoy is secured and which defines a filling conduit for the buoy that at one end defines an ingress through which air can be introduced and at its other end comprises an aperture over a rim of which a mouth of the buoy is located.

Preferably, the locking means is operated by a finger-catch incorporated into a handle for the apparatus so that the apparatus can be held and the finger-catch deployed to unlock the reel by the diver using only one hand.

Preferably also, the locking means comprises a latch which in a first position locks the reel against rotation and in a second position releases the reel for rotation. Alternatively, the locking means comprise a frictional braking means which operates to oppose rotation of the reel in proportion to pressure applied thereto.

In one embodiment the mouth of the buoy is releasably secured to the rim of the aperture by an elastic ligature whereby the buoy will pull away off the rim and out of the grip of the ligature when its buoyancy increases beyond a predetermined level.

However, in a preferred embodiment, the mouth of the buoy is secured around the rim of the aperture and the anchoring means is releasably connected to or releasably seated over the reel whereby when the buoy is inflated and the reel unlocked both the anchoring means and the buoy detach from the reel to ascend together.

Preferably, when the anchoring means is releasably seated over the reel it can be held in position by tension applied to the line by the locked reel, release of the locking means by the diver to free the reel for rotation also releasing the anchoring means from its seating for ascent with the buoy.

In a modification of the latter embodiment, the anchoring means comprises a first part to which the buoy is secured and a second part which is secured to the reel, the first and second parts being releasably connected together whereby when the buoy is inflated and the reel unlocked the first part of the anchoring means detaches from the second part to ascend together with the buoy.

Preferably also, the first part comprises a slider which can slide transversely over a portion of the second part. Advantageously, at least one of the first and second parts defines a taper to ease release of the first part from the second part as the slider slides transversely over the second part.

Preferably also, rollers are provided between the part and the portion of the second part.

Alternatively or in addition, the adjoining surfaces of the first and second parts are provided with a coating having a low coefficient of friction, such as a PTFE (polytetrafluoroethylene) coating.

Preferably also, the line is attached to the buoy via an elastic tag whereby the line can be wound tightly around the reel prior to release of the buoy to anchor the buoy to the reel.

Preferably also, the reel is integrally formed with at least a portion of the anchoring means. Alternatively, the reel is detachably mounted to part of the anchoring means.

Preferably also, the ingress comprises a spout with a flared aperture which in use is angled downwardly. Alternatively, the ingress may comprise a tube through which the diver can blow air into the filling conduit.

Preferably also, the mouth of the buoy comprises a one-way valve which- only permits air to enter the buoy. Alternatively or in addition, the anchoring means may comprise a one-way valve, which only permits air to flow therethrough in a direction that will fill the buoy.

Preferably also, the anchoring means comprises a pressure release valve, which permits air to flow therethrough in a direction that will empty the buoy when the air pressure in the buoy exceeds a predetermined level.

Advantageously, the one-way valve is provided with a manual opening mechanism to permit the buoy to be deflated after use.

BRIEF DESCRIPTION OF THE SEVERAL VIEWS OF THE DRAWINGS

The present invention will now be described by way of example with reference to the accompanying drawings.

In all of the embodiments and modifications described herein, the same reference numerals are used for the same or similar components of the apparatus.

DETAILED DESCRIPTION OF THE INVENTION

Figure 1:
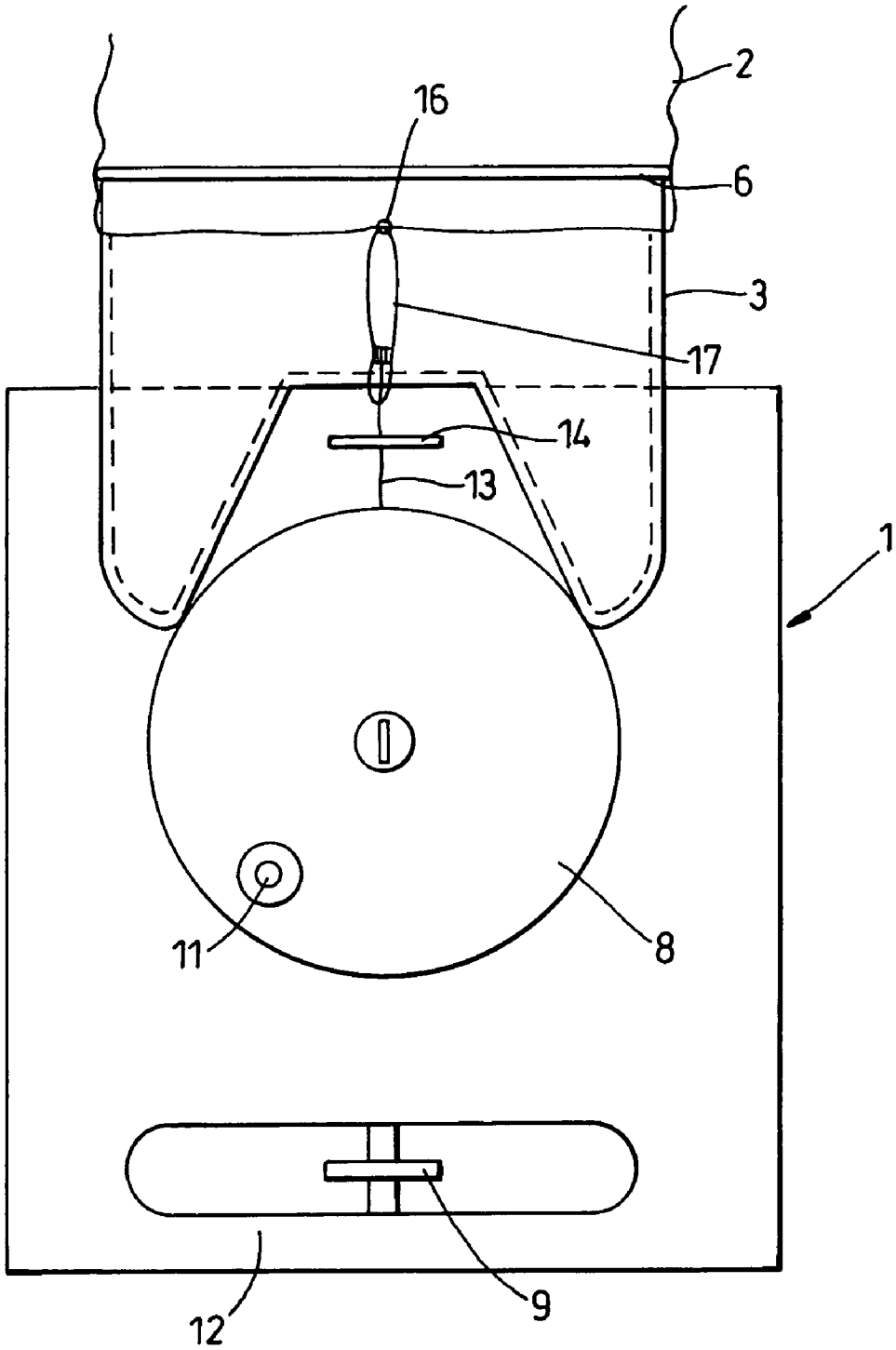
FIG. 1 is a front view of a surface marker buoy apparatus according to the present invention.
Figure 2:
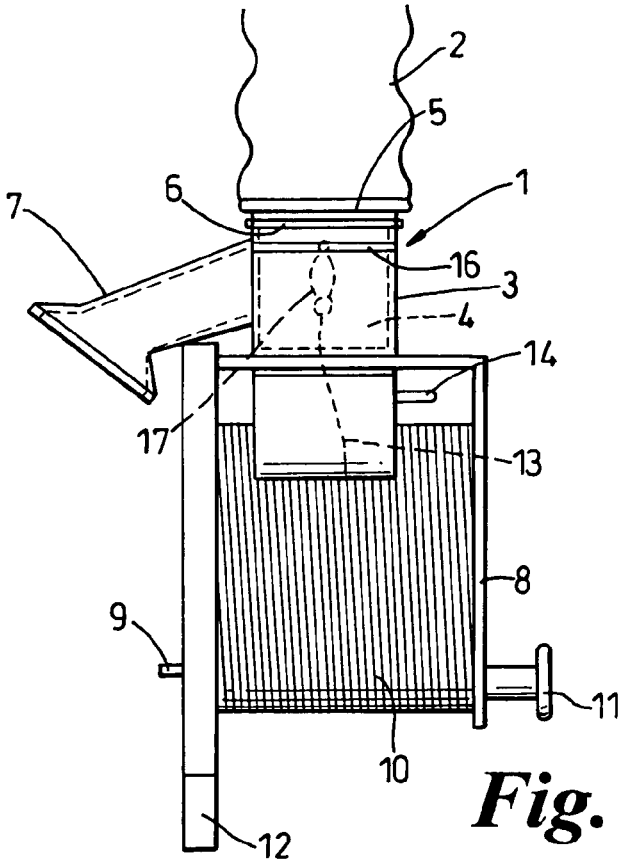
FIG. 2 is a side view of the apparatus shown in FIG. 1 but to a reduced scale.
Figure 3:
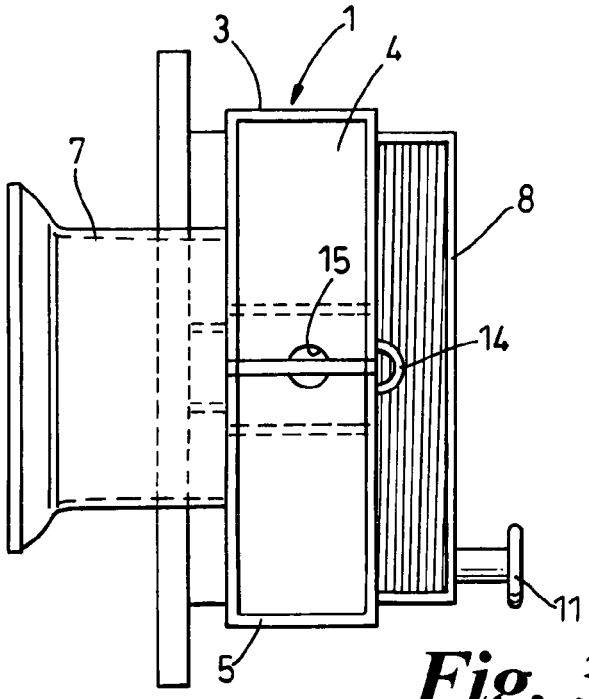
FIG. 3 is a plan view of the apparatus shown in FIGS. 1 and 2 but without the surface marker buoy attached thereto.

Referring firstly to FIGS. 1 to 3, the embodiment of surface marker buoy apparatus 1 shown therein comprises an inflatable surface marker buoy 2. The buoy 2 may be of conventional construction and comprise an inflatable cylindrical bag which can be rolled up when in a deflated condition. The buoy 2 is secured to an anchoring means 3 defining a filling conduit 4 for inflating the buoy 2. The conduit 4 has an aperture with a lipped rim 5 at one end around which a mouth of the buoy 2 is attached by a ligature 6. Preferably, to prevent the escape of air from the buoy 2 after and during its release, the mouth of the buoy 2 comprises a one-way valve (not shown) which only permits air to enter the buoy 2.

The other end of the filling conduit 4 defines an ingress 7 through which air can be introduced into the conduit 4 to flow upwardly to inflate the buoy 2. The ingress 7 preferably comprises a spout with a flared aperture, which in use is angled downwardly, to facilitate a diver inserting his mouthpiece or other air source into the conduit 4 to release air therein. Such alternative air sources may comprise an air gun, the diver's mouth so that exhaled air is used directly to inflate the buoy 2, or the diver's demand valve, which releases exhaust air from the diver's breathing equipment. The ingress may alternatively comprise a tube attached to the filling conduit through which the diver can blow air into the conduit 4. The tube may also comprise a mouthpiece at its end to assist the diver.

Preferably, an elastic securement member (not shown) is attached to the exterior of the anchoring means 3 or other portion of the apparatus 1 in order that when in a deflated condition, the buoy 2 can be folded or rolled up and releasably attached to the apparatus 1 by means of the member.

In this first embodiment, the anchoring means 3 is detachably mounted to a lockable reel 8. As shown in FIG. 1, the lower portion of the means 3 has a saddle shape that straddles and is seated over the top of the reel 8. In other embodiments of the invention, as described below, the anchoring means 3 may be made in two parts, a first part of which is connected to the buoy 2 and a second part of which is secured to or integrally formed with a frame of the reel 8. Conveniently, in such an arrangement the reel 8 and the second part of the anchoring means 3 are bolted together via a bolt located centrally of the reel 8 (see FIGS. 4 and 5 as described below).

The reel 8 comprises a locking means which can be set to oppose rotation of the reel 8. Preferably, the reel 8 is provided with a spring-loaded latch (not shown) operated by a finger-catch 9 that when manually released enables the reel 8 to rotate to pay out a line 10 wound thereon. However, when not released, the latch prevents rotation of the reel 8 and thereby prevents the line 10 from being paid out by the reel. Preferably, the latch comprises a ratchet locking arrangement (not shown) so that when the diver winds in the line 10 using a turning knob 11 provided on the side of the reel 8, it can be wound tightly on the reel 8. The finger-catch 9 is incorporated into a handle 12 for the apparatus 1, which handle 12 is conveniently formed as part of a frame for the reel 8. The apparatus 1 can thus be held and the finger-catch 9 deployed to release the latch at the same time by the diver using only one hand.

The line 10 can be of any conventional construction suitable for use in diving and may comprise a conventional decompression line or cable.

The line 10 is wound around the reel 8 and its free end 13 is attached to the buoy 2. In the first embodiment shown in FIGS. 1 to 3, the free end 13 passes through a hole 15 in the anchoring means 3 and into the filling conduit 4 where it is attached to a tie-bar 16 or loop of the inflatable buoy 2 that is inserted into the conduit 4. In order that the line 10 can be wound tightly around the reel 8 prior to release of the buoy, the end 13 of the line 10 is attached to the tie-bar 16 via an elastic line tie 17 which can stretch to accommodate rotation of the reel 8 past one ratchet position of the locking arrangement when the line 10 is being wound thereon. In this way the line 10 can be wound tightly around the reel 8 to anchor the buoy 2 firmly by the tension applied to the line 10 by the locked reel 8 until the latch is released by the diver operating the finger-catch 9. Release of the latch by the diver thereby frees the reel 8 for rotation and also releases the anchoring means 3 from its seating for ascent with the buoy 2.

In use, a diver will take the apparatus 1 as described above with him when diving, the mouth 6 of the buoy 2 being secured to the rim 5 of the aperture 6, the line 10 on the reel 8 being tightly wound, and the buoy 2 itself being deflated and folded away or rolled up and secured by the securement member. When the diver wishes to finish his dive and ascend to the surface he will deploy the apparatus 1 as follows. First, he will release the buoy 2 from the securement member so that it can be inflated. He will then hold the apparatus 1 upright with one hand using the handle 12 so that the buoy 2 is uppermost as shown in FIGS. 1 to 3. He can then inflate the buoy using his other hand, for example by removing his mouthpiece and either exhaling directly into the ingress 7 or more conveniently inserting the mouthpiece into the ingress 7 and releasing compressed air into the filling conduit 3 to inflate the buoy. Alternatively, another air source, such as an air gun, can be employed. When he has inflated the buoy sufficiently it can be released by releasing the latch locking the reel 8 by using the finger-catch 9 so that the reel 8 can pay out the line 10. It is not necessary for the buoy 2 to be fully inflated prior to its release because the air inside it will expand to fully fill the buoy as it ascends.

When the buoy 2 is released, both it and the anchoring means 3 will swiftly ascend to the surface together, the buoy 2 pulling the line 10 off the reel 8 as it and the means 3 rise for as long as the latch on the reel 8 remains released, which the diver should ensure is the case for as long as it takes the buoy to reach the surface. The ascent of the buoy 2 typically takes only a few seconds.

Once the buoy 2 has reached the surface, the diver should release his finger pressure on the finger-catch 9 so that the reel is locked. He can then make his own ascent up the line 10 in a conventional fashion, stopping to make appropriate decompression stops and reeling in the slack line 10 as does so.

Figure 4:
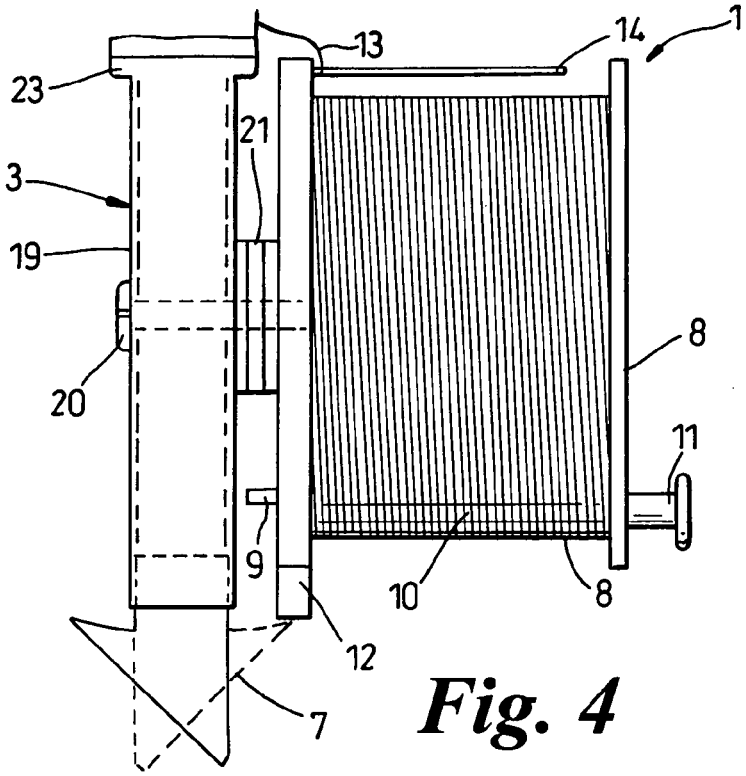
FIGS. 4 and 5 are side and front views respectively of part of a second embodiment of apparatus, again without a surface marker buoy attached thereto.
Figure 5:
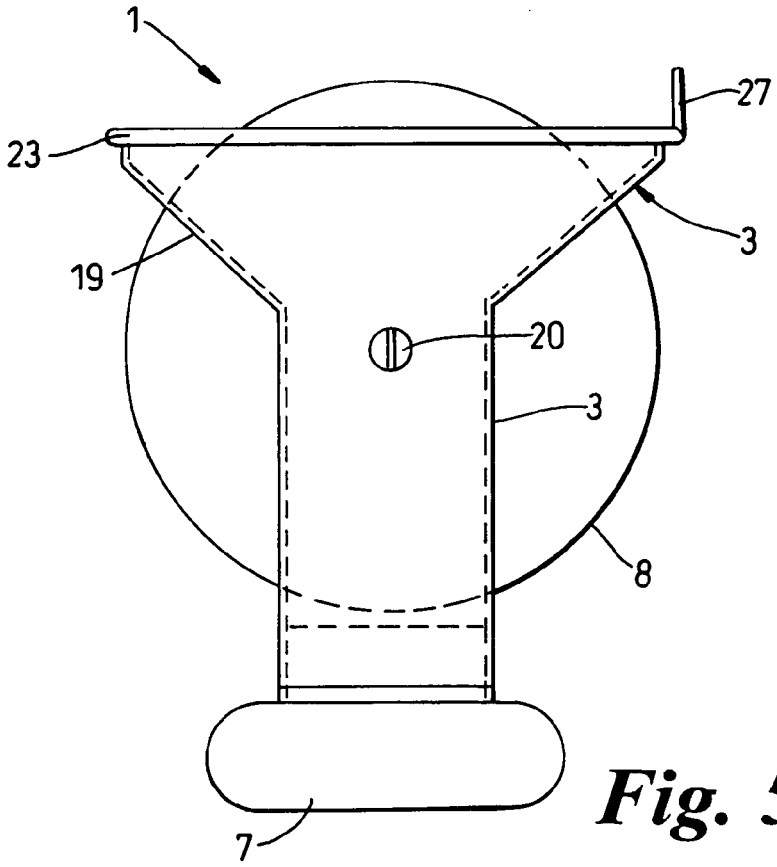

Turning now to the second embodiment shown in FIGS. 4 to 8, here the anchoring means 3 comprises a first part 18 which is releasably connected to a second part 19 that is secured to the reel 8, for example as shown in FIGS. 4 and 5 by a bolt 20 and resilient washer 21 located centrally of the reel 8. In this embodiment the reel 8 may comprise a friction reel, where a nut (not shown) is unscrewed or tightened on the central bolt 20 to adjust frictionally the freedom that the reel 8 has to rotate. The locking means in such an arrangement therefore comprises a frictional braking means which operates to oppose rotation of the reel in proportion to the pressure applied thereto by the nut. However, the reel 8 may alternatively be provided with a latch operated by a finger catch 9 as described above.

Figure 6:
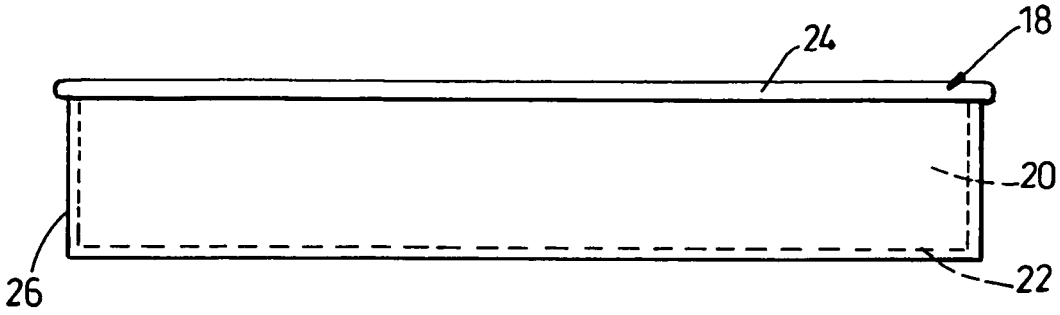
FIGS. 6 and 7 are side and plan views of part of a slider for use with the part of the apparatus shown in FIGS. 4 and 5.
Figure 7:
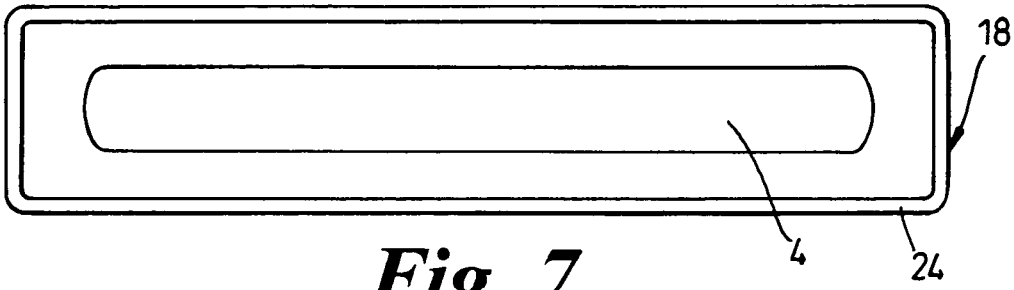
Figure 8:
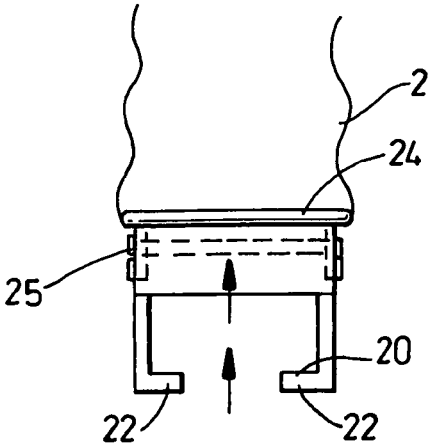
FIG. 8 is a side end view of the slider shown in FIGS. 6 and 7 with a surface marker buoy connected thereto and part of a filling conduit of the apparatus.
Figure 8:
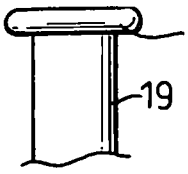

In this embodiment only the first part 18 of the anchoring means 3 is intended to ascend to the surface with the buoy 2, the second part 19 remains secured to the reel 8. To this end the first part 18, as shown in FIGS. 6 to 8, comprises a slider with inwardly turned lower flanges 22 that are adapted to slide transversely beneath a laterally projecting flange 23 formed at the top end of the second part 19. The first part 18 also comprises a lipped rim 24 over which the mouth of the buoy 2 is secured by a ligature or other binding 25. The slider may comprise a blocked-off end 26, as shown in FIG. 6, so that the slider can only slide on and off the other end of the second part 19. Alternatively, a stop 27 may be provided at one end of the top of the second part 19.

The second part 19 of the anchoring means 3 comprises the ingress V, which is preferably in the form of a rotatably mounted spout at the bottom of the filling conduit 4 so that the apparatus can be adapted for use by either right- or left-handed divers. Additionally, to facilitate inflation of the buoy 2, the spout 7 of the second part 19 could be made telescopically extendible so that the filling conduit 4 can be extended downwardly away from the reel 8 prior to use to give more space around it.

In this embodiment, the buoy 2 is again released by releasing the locking means that opposes rotation of the reel 8, for example by using the finger-catch 9, so that the reel 8 can pay out the line 10 but the diver can control exactly when the buoy 2 commences its ascent by tipping the apparatus 1 to permit the first part 18 of the anchoring means 3 to slide off the second part 19 as soon as the buoy is sufficiently buoyant. To assist in this procedure, the flange 23 may be angled or inclined upwardly away from the stop 27.

To further assist in the smooth release of the buoy 2, rollers (not shown) may be provided between the flanges 22 and 23. Alternatively or in addition, the adjoining surfaces of the first and second parts 18 and 19 can be provided with a coating that has a low coefficient of friction, such as a PTFE (polytetrafluoroethylene) coating.

The sliding fit of the first part 18 on the second part 19 can also be made adjustable so that the first part 18 can be made to slide easily and swiftly over the second part 19. To this end, if the second part 19 is made from a resilient plastics material, it can be provided with a longitudinal slit so that its sides can be squeezed together or relaxed by the use of tightening bolts fitted transversely across the second part 19.

The filling conduit 4 may also be provided with strengthening ribs (not shown), if made of a plastics material, to prevent it from becoming deformed when subjected to water pressure in use. Such deformation could hinder release of the buoy 2.

As the buoy 2 is securely anchored to the first part 18 of the anchoring means 3, there is no requirement for an elastic tie line 17. Hence in this embodiment, the free end 13 of the line does not pass through the conduit 3 but is threaded through a line guide 14 forming part of the reel 8 and is clipped to a tie-bar or loop located on the exterior of buoy 2.

Figure 9:
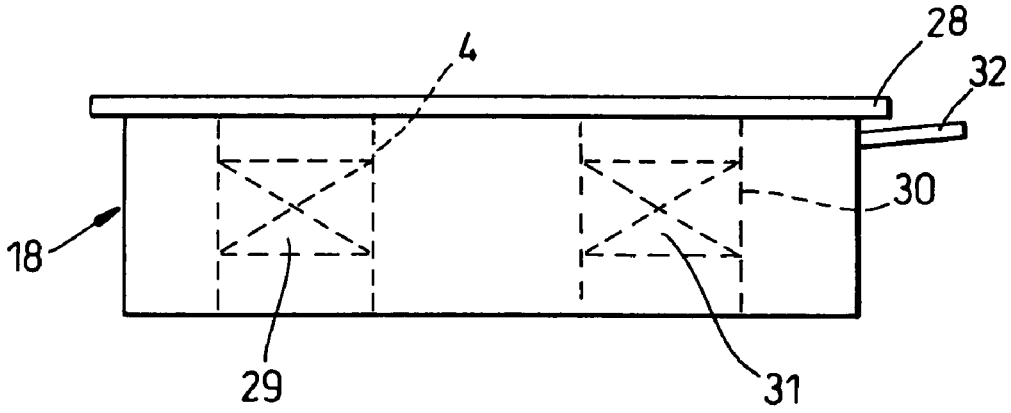
FIGS. 9 and 10 are side and plan views similar to FIGS. 6 and 7 respectively but of a modified slider.
Figure 10:
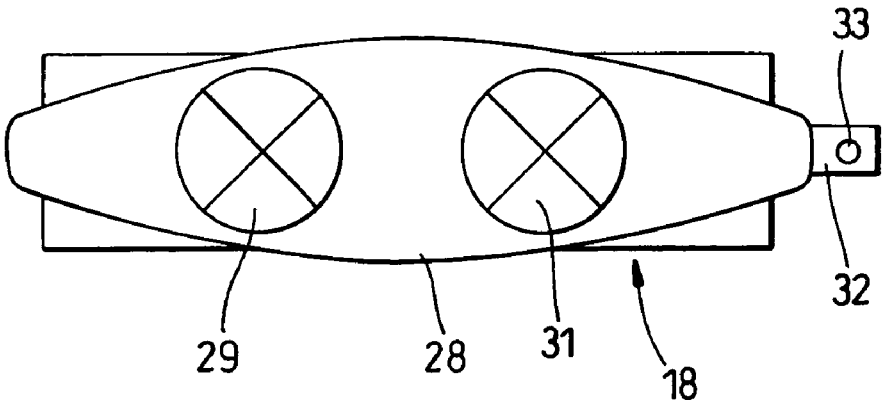
Figure 11:
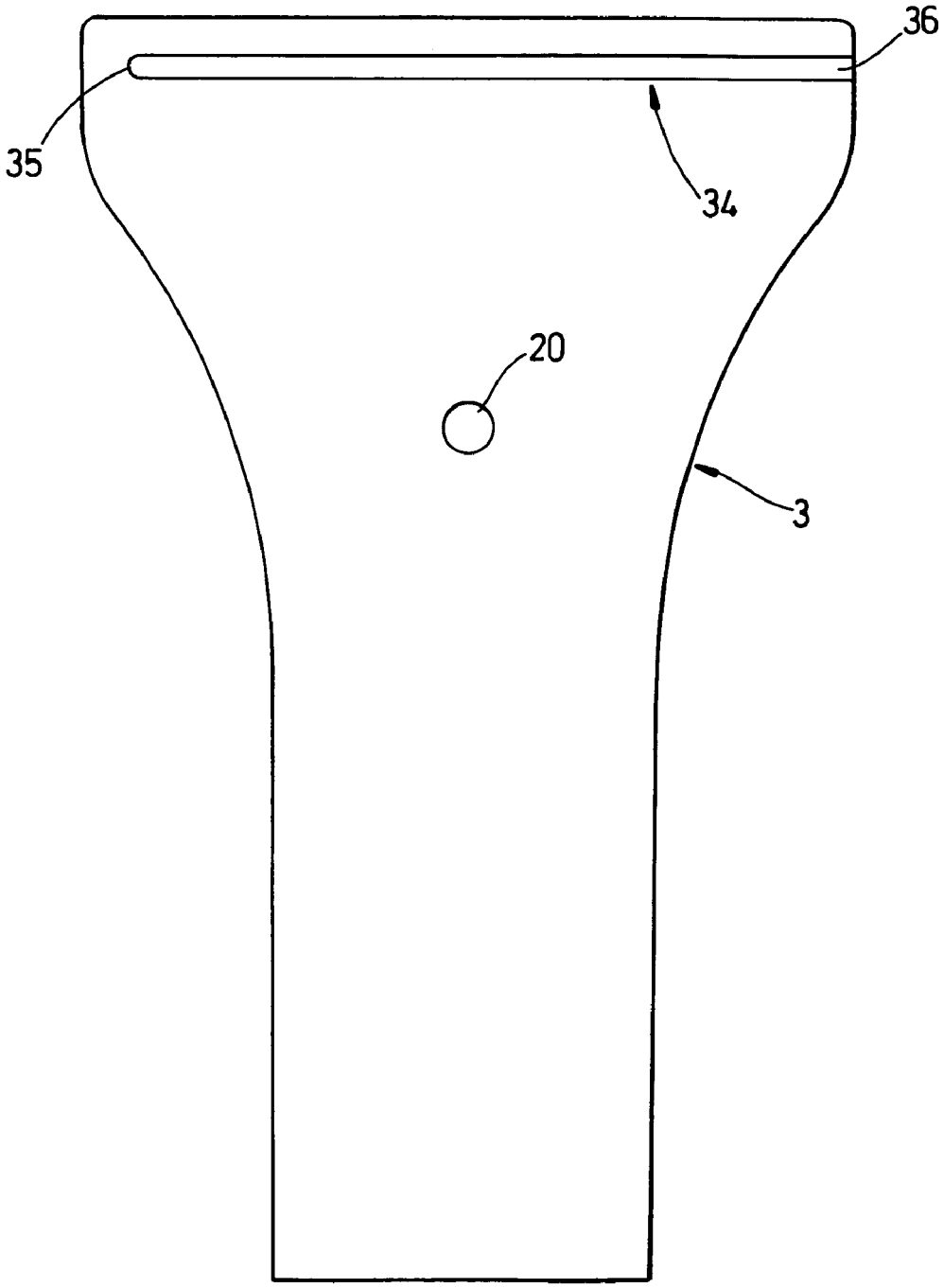
FIG. 11 is a side view of a filling conduit for use the slider shown in FIGS. 9 and 10.

In a modification of this embodiment as shown in FIGS. 8 to 10, the first part 18 of the anchoring means 3 defines a lipped rim 28 which has a boat shape with rounded ends to assist in the air-tight attachment of the mouth of the buoy 2 thereto. Also, rather than include a one-way valve in the mouth of the buoy 2, the filling conduit 4 in the first part 18 comprises a one-way valve 29, which only permits air to flow therethrough in a direction that will fill the buoy 2. Preferably, the first part 18 defines a second conduit 30 in which is located a pressure release valve 31 that permits air to flow therethrough in a direction that will empty the buoy 2. Hence, in this arrangement if the air pressure in the buoy 2 exceeds a predetermined level as determined by the setting of the pressure release valve 31, then air will be expelled therefrom, preventing a possible rupture of the buoy 2, particularly during its ascent. However, the function of a non-return filling valve and a pressure release valve may be combined in a single valve (not shown) which can be incorporated in the filling conduit 4, obviating the requirement for the second conduit 30.

If the mouth of the buoy is provided with a one-way valve, then this should be provided with a manual opening mechanism so that after use, the buoy 2 can be deflated for subsequent re-use. Such a manual mechanism could be operated by a ripcord or similar.

The first part 18 may also comprise a lug 32, which projects side-ways just beneath the lipped rim 28. The lug 32 is intended to protect through an eyelet (not shown) formed in the buoy 2 and defines a hole 33 so that the line 10 can be clipped to the first part 18 rather than directly to the buoy 2.

As with the previous arrangement, the first part 18 comprises a slider with inwardly turned lower flanges (not shown) but rather than these sliding transversely beneath a laterally projecting flange formed at the top end of the second part 19, they each locate respectively into one of two grooves 34 defined on each side of the second part 19 adjacent the top rim (see FIG. 10). To assist in the release of the first part 18 from the second part 19 during use of the apparatus, the depth of the grooves is at its highest adjacent a closed end 35 thereof and tapers to a narrower depth at the opposite open end 36 of the groove 34. Each groove 34 may define a depth that tapers from around 4 mm at its closed end 34 to around 3 mm at its open end 35. It will be appreciated that in a variation, the grooves 34 could be made with a constant depth and the depth of the in-turned lower flanges on the first part 18 made to taper instead to assist in freeing of the first part 18 from the second part 19.

In a further modification of this embodiment, the first and second parts 18 and 19 of the anchoring means 3 can be connected together with a push-fitted arrangement rather than a sliding arrangement. When the buoy 2 is inflated and its buoyancy increases beyond a predetermined level equivalent to the frictional force holding the first and second parts 18 and 19 together, the buoy 2 and the first part 18 will pull away from the second part 19 as soon as the latch locking the reel 8 is released. Alternatively, the first and second parts 18 and 19 of the anchoring means 3 may be clipped together by a device which can be released using a finger button or similar easily accessible by the hand of the diver holding the handle 12.

In yet a further embodiment, which can be made similar to the apparatus shown in FIGS. 4 and 5 without the addition of the slider 18, the whole of the anchoring means 3 can be permanently fixed to the reel 8 and the mouth of the buoy 2 releasably secured thereto around the flange 23 of the anchoring means by an elastic ligature (not shown). The grip of the ligature on the buoy 2 is predetermined such that the buoy 2 can pull free when its buoyancy increases beyond a predetermined level sufficient to overcome the frictional force exerted by the ligature.

It will be appreciated that the apparatus according to and deployed part of the invention enables the buoy 2 to be inflated without requiring excessive manual dexterity on the part of the diver, only one hand being required to hold the apparatus 1 and to release the latch on the reel 8 and any means anchoring the buoy 2, the diver's other hand being left free to manipulate the air source to inflate the buoy 2. The apparatus 1 itself holds open the mouth of the buoy 2 so that it can be inflated and anchors the buoy 2 until it is released.

I claim:

1. An ascent decompression surface marker buoy apparatus for a diver comprising:

an inflatable buoy having an inflated configuration suitable for floating on water when required to float and a deflated configuration suitable for folding or rolling up;

a reel having a locking means for opposing rotation of said reel;

a line wound around said reel and attached directly or indirectly to said inflatable buoy at a free end thereof; and an anchoring means to which said inflatable buoy is secured, said anchoring means for detachably connecting said reel to said inflatable buoy, said anchoring means defining a filling conduit for said inflatable buoy that at one end forms an ingress through which air can be introduced and at another end comprises an aperture over a rim of which a mouth of said inflatable buoy is located, an unlocking of said locking means for enabling said inflatable buoy to detach from said reel and ascend to a surface of the water as said reel unwinds to pay out said line when said inflatable buoy is in said inflated configuration, said locking means is operated by a finger-catch incorporated into a handle, said finger-catch suitable for unlocking said reel by only one hand of the diver.

2. The apparatus of claim 1, wherein said mouth of said buoy is releasably secured around said rim of said aperture by an elastic ligature whereby said buoy will pull away off the rim and out of the grip of the ligature when a buoyancy of said buoy increases beyond a predetermined level.

3. The apparatus of claim 1, wherein said mouth of said buoy is secured to said rim of said aperture and said anchoring means is releasably connected to or releasably seated over said reel whereby when said buoy is in said inflated configuration and said reel unlocked both said anchoring means and said buoy detach from said reel so as to ascend together in the water.

4. The apparatus of claim 1, wherein when said anchoring means is releasably seated over said reel so as to be held in position by tension applied to said line by the locked reel, said locking means being releasable by the diver to free the reel for rotation and for releasing said anchoring means from the seating for ascent with said buoy in the water.

5. The apparatus of claim 1, wherein said anchoring means comprises a first part to which said buoy is secured and a second part which is secured to said reel, said first and second parts being releasably connected together such that when the buoy is in said inflated configuration and said reel unlocked said first part of said anchoring means detaches from said second part so as to ascend together with said buoy in the water.

6. The apparatus of claim 5, wherein said first part comprises a slider which can slide transversely over a portion of said second part.

7. The apparatus of claim 6, wherein at least one of said first and second parts defines a taper arranged so as to ease release of said first part from said second part as said slider slides transversely over said second part.

8. The apparatus of claim 5, wherein adjoining surfaces of said first and second parts have a coating with a low coefficient of friction.

9. The apparatus of claim 1, wherein said line is attached to said buoy via an elastic tag whereby said line is wound tightly around said reel prior to release of said buoy so as to anchor said buoy to said reel.

10. The apparatus of claim 5, wherein said line is connected to said first part of said anchoring means.

11. The apparatus of claim 1, wherein said reel is integrally formed with at least a portion of said anchoring means.

12. The apparatus of claim 1, wherein said reel is detachably mounted to a portion of said anchoring means.

13. The apparatus of claim 1, wherein said ingress comprises a spout with a flared aperture that is angled downwardly.

14. The apparatus of claim 1, wherein said ingress comprises a tube suitable for allowing the diver to blow air into said filling conduit.

15. The apparatus of claim 1, wherein said anchoring means comprises a one-way valve that permits air to flow therethrough in a direction that will fill the buoy.

16. The apparatus of claim 1, wherein said anchoring means comprises a pressure release valve arranged so as to permit air to flow therethrough in a direction that empties said buoy when the air pressure in the buoy exceeds a predetermined level.

* * * * *